US011219240B2

(12) United States Patent
Minzoni

(10) Patent No.: US 11,219,240 B2
(45) **Date of Patent: *Jan. 11, 2022**

(54) PAPER WRAPPER FOR AN ELECTRICALLY HEATED AEROSOL-GENERATING ARTICLE

(71) Applicant: Philip Morris Products S.A., Neuchatel (CH)

(72) Inventor: Mirko Minzoni, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/747,947

(22) Filed: Jan. 21, 2020

(65) Prior Publication Data

US 2020/0154758 A1 May 21, 2020

Related U.S. Application Data

(63) Continuation of application No. 15/557,522, filed as application No. PCT/EP2016/056581 on Mar. 24, 2016, now Pat. No. 10,575,553.

(30) Foreign Application Priority Data

Mar. 27, 2015 (EP) ..... 15161538

(51) Int. Cl.
*A24F 47/00* (2020.01)
*A24D 1/02* (2006.01)
(Continued)

(52) U.S. Cl.
CPC ..... *A24D 1/02* (2013.01); *A24D 1/002* (2013.01); *A24D 1/20* (2020.01); *A24F 40/40* (2020.01); *D21H 21/20* (2013.01); *D21H 27/10* (2013.01)

(58) Field of Classification Search
CPC ..... A24D 1/02; A24D 1/20
See application file for complete search history.

(56) References Cited

U.S. PATENT DOCUMENTS 2,250,367 A 4/1950 Harrison
2,595,935 A 5/1952 Daniel et al.
(Continued)

FOREIGN PATENT DOCUMENTS

CN 1190335 A 8/1998
CN 102240065 A 11/2011
(Continued)

OTHER PUBLICATIONS

Office Action dated Aug. 27, 2019 in Chinese Application No. 201680015133.3, along with an English translation, citing reference AP above.
(Continued)

*Primary Examiner* — Eric Yaary
(74) *Attorney, Agent, or Firm* — Oblon, McClelland, Maier & Neustadt, L.L.P.

(57) ABSTRACT

An electrically heated aerosol-generating article is provided, including an aerosol-generating substrate including at least one aerosol former in an amount of between 5 percent and 30 percent by weight of the aerosol-generating substrate; a mouthpiece; and a paper wrapper circumscribing at least a portion of the aerosol-generating substrate, the paper wrapper having a wet tensile strength of at least 5 Newtons per 15 millimeters when measured in accordance with the Wet Tensile Strength Test.

14 Claims, 3 Drawing Sheets

| | | | |
|---|---|---|---|
| w | = | Width of the test specimen | [mm] |
| l o | = | Initial length between grips | [mm] |
| l | = | Length between grips during the stretch | [mm] |
| Δl | = | Elongation during the stretch (*l = l – lo) | [mm] |
| F | = | Force during the stretch | [N] |

(51) Int. Cl.

| | |
|---|---|
| ***D21H 21/20*** | (2006.01) |
| ***D21H 27/10*** | (2006.01) |
| ***A24F 40/40*** | (2020.01) |
| ***A24D 1/20*** | (2020.01) |
| ***A24D 1/00*** | (2020.01) |

(56) References Cited

U.S. PATENT DOCUMENTS

| | | | |
|---|---|---|---|
| 4,981,522 | A | 1/1991 | Nichols et al. |
| 5,388,594 | A | 2/1995 | Counts et al. |
| 5,397,436 | A | 3/1995 | Robeson et al. |
| 5,505,214 | A | 4/1996 | Collins et al. |
| 5,591,368 | A | 1/1997 | Fleischhauer et al. |
| 5,666,978 | A | 9/1997 | Counts et al. |
| 5,692,525 | A | 12/1997 | Counts et al. |
| 6,676,806 | B1 | 1/2004 | Butt, Sr. |
| 2005/0066986 | A1 | 3/2005 | Nestor et al. |
| 2006/0027243 | A1 | 2/2006 | Matsufuji et al. |
| 2007/0102013 | A1 | 5/2007 | Adams et al. |
| 2008/0092912 | A1 | 4/2008 | Robinson et al. |
| 2008/0216851 | A1 | 9/2008 | Olegario et al. |
| 2010/0200006 | A1 | 8/2010 | Robinson et al. |
| 2011/0290269 | A1 | 12/2011 | Shimizu |
| 2012/0006343 | A1 | 1/2012 | Renaud et al. |
| 2012/0060853 | A1 | 3/2012 | Robinson et al. |
| 2012/0177996 | A1 | 7/2012 | Gupta et al. |
| 2012/0183861 | A1 | 7/2012 | Gupta et al. |
| 2013/0146075 | A1 | 6/2013 | Paget |
| 2014/0137880 | A1 | 5/2014 | Zitturi et al. |
| 2014/0166032 | A1 | 6/2014 | Gindrat |
| 2015/0040930 | A1 | 2/2015 | Robinson et al. |
| 2015/0047656 | A1 | 2/2015 | Robinson et al. |
| 2015/0150302 | A1 | 6/2015 | Metrangolo et al. |
| 2016/0331032 | A1 | 11/2016 | Malgat et al. |
| 2017/0215475 | A1 | 8/2017 | Besso et al. |

FOREIGN PATENT DOCUMENTS

| | | | |
|---|---|---|---|
| CN | 102821625 | A | 12/2012 |
| CN | 103180508 | A | 6/2013 |
| CN | 104005269 | A | 8/2014 |
| CN | 104010531 | A | 8/2014 |
| CN | 104195875 | A | 12/2014 |
| CN | 104411189 | A | 3/2015 |
| DE | 2532102 | A1 | 4/1976 |
| EP | 0 857 431 | A1 | 8/1998 |
| EP | 2 394 520 | A1 | 12/2011 |
| EP | 3 076 810 | B1 | 2/2018 |
| EP | 2 552 246 | B1 | 5/2018 |
| EP | 3 145 341 | B1 | 7/2018 |
| JP | 7-316996 | A | 12/1995 |
| JP | 2000-64192 | A | 2/2000 |
| JP | 2009-191393 | A | 8/2009 |
| JP | WO2011/114530 | A1 | 9/2011 |
| KR | 10-0844445 | B1 | 7/2008 |
| KR | 10-1317137 | B1 | 10/2013 |
| RU | 138 230 | U1 | 3/2014 |
| WO | WO 2011/114529 | A1 | 9/2011 |
| WO | WO-2012164009 | A2 | 12/2012 |
| WO | WO 2015/035137 | A1 | 3/2015 |

OTHER PUBLICATIONS

Combined Russian Decision to Grant and Search Report dated Jun. 26, 2019 in Russian Patent Application No. 2017134579 (with English translation), citing documents AQ therein, 13 pages.

Japanese Decision to Grant dated Jun. 10, 2019 in Japanese Patent Application No. 2017-545965 (with English translation), citing documents AR and AS therein, 4 pages.

Extended European Search Report dated Oct. 6, 2015 in Patent Application No. 15161538.2.

International Search Report and Written Opinion dated Jun. 23, 2016 in PCT/EP2016/056581, filed Mar. 24, 2016.

Japanese Office Action dated Oct. 22, 2020 in Japanese Patent Application No. 2019-147688 (with English translation), citing document AO therein, 11 pages.

Indian Office Action dated Jan. 27, 2021 in Indian Patent Application No. 201717025127, 5 pages.

Office Action and Search Report dated Oct. 9, 2021 in Chinese Patent Application No. 202010303147.3, (with English translation).

Jiang Gu, edited, "Soft Packaging Material and Composite Technology", Jan. 2008, Beijing, Printing Industry Press, pp. 156-162. (with English translation of relevant portions).

Luo Guanglin, et al., edited, Packaging Materials, Aug. 2011, 2nd edition, Beijing, Printing Industry Press, pp. 131-134. (with English translation of relevant portions).

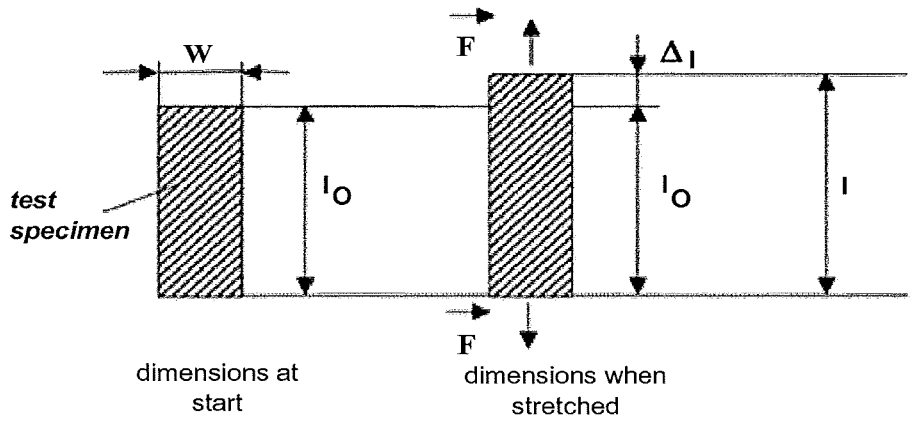

| | | | |
|---|---|---|---|
| w | = | Width of the test specimen | [mm] |
| l o | = | Initial length between grips | [mm] |
| l | = | Length between grips during the stretch | [mm] |
| $\Delta l$ | = | Elongation during the stretch (*l = l – lo) | [mm] |
| F | = | Force during the stretch | [N] |

Figure 1

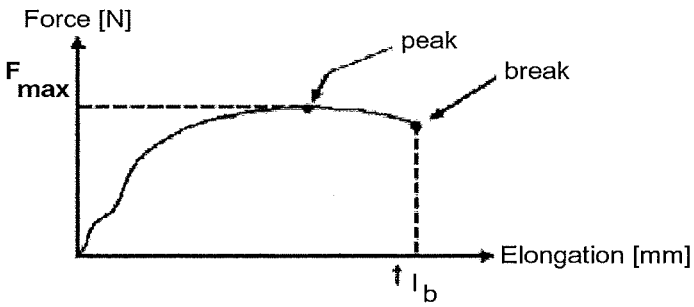

Definitions for plug wrap paper, cigarette paper, banded cigarette paper, tipping paper, and pre-cut tipping paper.

| | | | |
|---|---|---|---|
| L | = | Load max | [N] |
| S | = | Tensile strength | [N/mm] |
| S at break | = | Tensile Breaking Strength | [N/15mm] |
| $\varepsilon_b$ | = | Stretch at break | [%] |
| $F_{max}$ | = | Maximum force during the stretch | [N] |
| w | = | Width of the test specimen | [mm] |
| $l_o$ | = | Initial length between grips | [mm] |
| $\Delta l_b$ | = | Elongation at break | [mm] |

Figure 2

Tensile breaking strength $S = \frac{F_{max}}{w}[N/mm]$

Stretch at Break $\varepsilon_b = \frac{\Delta l_b}{l_o}.100[\%]$

Force at break of pre-cut tipping paper L = Load max [N]

| | standard paper | |
|---|---|---|
| standard measurement | | |
| | Tensile strength | Stretch at break |
| | [N/15mm] | [%] |
| 1 | 14.97 | 1.45 |
| 2 | 15.60 | 1.52 |
| 3 | 14.81 | 1.42 |
| average | 15.1 | 1.5 |
| stdev | 0.42 | 0.05 |
| CV% | 2.8 | 3.5 |

Figure 3A

| | High Wet Strength Paper | |
|---|---|---|
| standard measurement | | |
| | Tensile strength | Stretch at break |
| | [N/15mm] | [%] |
| 1 | 15.39 | 1.98 |
| 2 | 14.55 | 1.89 |
| 3 | 15.52 | 1.93 |
| average | 15.2 | 1.9 |
| stdev | 0.53 | 0.05 |
| CV% | 3.5 | 2.3 |

Figure 3B

| | standard paper | |
|---|---|---|
| 2µl $H_2O$ measurement | | |
| | Tensile strength | Stretch at break |
| | [N/15mm] | [%] |
| 1 | 0.56 | 0.55 |
| 2 | 0.77 | 0.63 |
| 3 | 0.75 | 0.72 |
| average | 0.7 | 0.6 |
| stdev | 0.12 | 0.09 |
| CV% | 16.7 | 13.4 |

Figure 4A

| | High Wet Strength Paper | |
|---|---|---|
| 2µl $H_2O$ measurement | | |
| | Tensile strength | Stretch at break |
| | [N/15mm] | [%] |
| 1 | 6.38 | 0.93 |
| 2 | 6.28 | 1.18 |
| 3 | 6.05 | 0.86 |
| average | 6.2 | 1.0 |
| stdev | 0.17 | 0.17 |
| CV% | 2.7 | 17.0 |

Figure 4B

| | standard paper | |
|---|---|---|
| 2µl Glycerin measurement | | |
| | Tensile strength | Stretch at break |
| | [N/15mm] | [%] |
| 1 | 10.39 | 0.61 |
| 2 | 9.90 | 0.59 |
| 3 | 11.05 | 0.7 |
| average | 10.4 | 0.6 |
| stdev | 0.58 | 0.06 |
| CV% | 5.5 | 9.3 |

Figure 5A

| | High Wet Strength Paper | |
|---|---|---|
| 2µl Glycerin measurement | | |
| | Tensile strength | Stretch at break |
| | [N/15mm] | [%] |
| 1 | 13.06 | 1.48 |
| 2 | 13.85 | 1.51 |
| 3 | 13.33 | 1.55 |
| average | 13.4 | 1.5 |
| stdev | 0.40 | 0.04 |
| CV% | 3.0 | 2.3 |

Figure 5B

| | standard paper | |
|---|---|---|
| 2µl $H_2O$ + Glycerin measurement | | |
| | Tensile strength | Stretch at break |
| | [N/15mm] | [%] |
| 1 | 1.32 | 0.41 |
| 2 | 1.04 | 0.42 |
| 3 | 0.78 | 0.39 |
| average | 1.0 | 0.4 |
| stdev | 0.27 | 0.02 |
| CV% | 25.8 | 3.8 |

| | High Wet Strength Paper | |
|---|---|---|
| 2µl $H_2O$ + Glycerin measurement | | |
| | Tensile strength | Stretch at break |
| | [N/15mm] | [%] |
| 1 | 7.94 | 0.67 |
| 2 | 8.12 | 0.76 |
| 3 | 7.38 | 0.66 |
| average | 7.8 | 0.7 |
| stdev | 0.39 | 0.06 |
| CV% | 4.9 | 7.9 |

PAPER WRAPPER FOR AN ELECTRICALLY HEATED AEROSOL-GENERATING ARTICLE

CROSS-REFERENCE TO RELATED APPLICATIONS

This application is a continuation of U.S. application Ser. No. 15/557,522, filed Jan. 12, 2018, which is a National Stage of International Application No. PCT/EP2016/056581, filed Mar. 24, 2016, which is based upon and claims the benefit of priority from European Patent Application No. 15161538.2, filed on Mar. 27, 2015, the entire contents of which are incorporated herein by reference.

The present invention relates to a paper wrapper for an electrically heated aerosol-generating article, an electrically heated aerosol-generating article comprising the paper wrapper, and the use of the paper wrapper in the manufacture of an electrically heated aerosol-generating article.

One type of aerosol-generating system is an electrically operated smoking system. Known handheld electrically operated smoking systems typically comprise an aerosol-generating device comprising a battery, control electronics and an electric heater for heating an aerosol-generating article designed specifically for use with the aerosol-generating device. In some examples, the aerosol-generating article comprises a plug of an aerosol-generating substrate, such as a tobacco plug, and the heater contained within the aerosol-generating device is inserted into the aerosol-generating substrate when the aerosol-generating article is inserted into the aerosol-generating device.

However, in some cases the consumer may experience difficulty in removing the aerosol-generating article from the aerosol-generating device after use. For example, in some instances an outer wrapper of the aerosol-generating article may tear when removing the aerosol-generating article from the aerosol-generating device, which may contaminate the interior of the aerosol-generating device with portions of the wrapper and portions of the aerosol-generating substrate.

Accordingly, it would be desirable to provide a wrapper for an electrically heated aerosol-generating article that facilitates removal of the aerosol-generating article from an aerosol-generating device. It would be particularly desirable to provide such a wrapper that minimises the risk of the wrapper tearing when removing the aerosol-generating article from the aerosol-generating device.

According to a first aspect of the present invention there is provided an electrically heated aerosol-generating article comprising an aerosol-generating substrate, a mouthpiece, and a paper wrapper circumscribing at least a portion of the aerosol-generating substrate. The aerosol-generating substrate comprises at least one aerosol former in an amount of between about 5 percent and about 30 percent by weight of the aerosol-generating substrate. The paper wrapper has a wet tensile strength of at least about 5 Newtons per 15 millimetres when measured in accordance with the Wet Tensile Strength Test.

According to a second aspect of the present invention there is provided a paper wrapper for an electrically heated aerosol-generating article, the paper wrapper having a wet tensile strength of at least about 5 Newtons per 15 millimetres when measured in accordance with the Wet Tensile Strength Test.

The Wet Tensile Strength Test measures the tensile strength of a wet sheet material and is described herein in the Test Methods section.

As used herein, the term "aerosol-generating article" refers to an article comprising an aerosol-generating substrate that, when heated, releases volatile compounds that can form an aerosol. The aerosols generated from aerosol-generating substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The present inventors have recognised that electrically heated aerosol-generating articles typically comprise an aerosol-generating substrate having a higher moisture content when compared to the tobacco rod of a conventional cigarette, for example. The inventors have further recognised that the higher moisture content can significantly wet the conventional paper wrappers of known electrically heated aerosol-generating articles when heated in an aerosol-generating device, which can significantly weaken the paper wrapper and cause it to tear when the aerosol-generating article is removed from the aerosol-generating device. However, the present invention addresses this problem by providing a paper wrapper having a wet tensile strength of at least about 5 Newtons per 15 millimetres when measured in accordance with the Wet Tensile Strength Test.

In preferred embodiments, the paper wrapper also has a dry tensile strength of at least about 10 Newtons per 15 millimetres when measured in accordance with the Dry Tensile Strength Test, set out in the Test Methods section. Advantageously, providing the inventive wrapper with a dry tensile strength of at least about 10 Newtons per 15 millimetres can minimise or eliminate the need to modify existing high speed manufacturing machines for assembling electrically heated aerosol-generating articles by providing the wrapper with a dry tensile strength that is substantially the same as the dry tensile strength of conventional paper wrappers.

The aerosol-generating substrate preferably comprises both solid and liquid components. The aerosol-generating substrate may comprise an aerosol-generating material containing tobacco. Alternatively, the aerosol-forming substrate may comprise a non-tobacco containing aerosol-generating material.

The aerosol-generating substrate comprises at least one aerosol former in an amount of between about 5 percent and about 30 percent by weight of the aerosol-generating substrate, preferably between about 10 percent and about 30 percent by weight of the aerosol-generating substrate, more preferably between about 10 percent and about 20 percent by weight of the aerosol-generating substrate. An aerosol former is a substance that generates an aerosol upon heating.

The aerosol former may comprise at least one of a polyol aerosol former and a non-polyol aerosol former. It may be a solid or liquid at room temperature, but preferably is a liquid at room temperature. Suitable polyols include sorbitol, glycerol, and glycols like propylene glycol or triethylene glycol. Suitable non-polyols include monohydric alcohols, such as menthol, high boiling point hydrocarbons, acids such as lactic acid, and esters such as diacetin, triacetin, triethyl citrate or isopropyl myristate. Aliphatic carboxylic acid esters such as methyl stearate, dimethyl dodecanedioate and dimethyl tetradecanedioate can also be used as aerosol formers agents. A combination of aerosol formers may be used, in equal or differing proportions. Polyethylene glycol and glycerol may be particularly preferred, whilst triacetin is more difficult to stabilise and may also need to be encapsulated in order to prevent its migration within the aerosol-generating article. Examples of suitable aerosol formers are glycerine and propylene glycol.

In any of the embodiments described above, the aerosol-generating substrate may comprise water in an amount of between about 10 percent and about 20 percent by weight of the aerosol-generating substrate.

The at least one aerosol-generating substrate may include one or more flavouring agents, such as cocoa, liquorice, organic acids, or menthol. The at least one aerosol-generating substrate may comprise a solid substrate. The solid substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. Optionally, the solid substrate may contain additional tobacco or non-tobacco volatile flavour compounds, to be released upon heating of the substrate. Optionally, the solid substrate may also contain capsules that, for example, include the additional tobacco or non-tobacco volatile flavour compounds. Such capsules may melt during heating of the solid aerosol-generating substrate. Alternatively, or in addition, such capsules may be crushed prior to, during, or after heating of the solid aerosol-generating substrate.

Where the at least one aerosol-generating substrate comprises a solid substrate comprising homogenised tobacco material, the homogenised tobacco material may be formed by agglomerating particulate tobacco. The homogenised tobacco material may be in the form of a sheet. As used herein, the term 'sheet' denotes a laminar element having a width and length substantially greater than the thickness thereof. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface. The aerosol-generating substrate may comprise a gathered sheet of homogenised tobacco material. As used herein, the term 'gathered' is used to describe a sheet that is convoluted, folded, or otherwise compressed or constricted substantially transversely to the longitudinal axis of the aerosol-generating article. Additionally, or alternatively, the sheet of homogenised tobacco material may be crimped. As used herein, the term 'crimped' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article.

Optionally, the solid substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, such as those disclosed in U.S. Pat. Nos. 5,505,214, 5,591,368 and 5,388,594, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix. The solid substrate may be deposited on the surface of the carrier in the form of, for example, a sheet, foam, gel or slurry. The solid substrate may be deposited on the entire surface of the carrier, or alternatively, may be deposited in a pattern in order to provide a predetermined or non-uniform flavour delivery during use. Alternatively, the carrier may be a non-woven fabric or fibre bundle into which tobacco components have been incorporated, such as that described in EP-A-0 857 431. The non-woven fabric or fibre bundle may comprise, for example, carbon fibres, natural cellulose fibres, or cellulose derivative fibres.

In any of the embodiments described above, the paper wrapper may circumscribe only the aerosol-generating substrate. Alternatively, the paper wrapper may circumscribe the aerosol-generating substrate and the mouthpiece to secure the mouthpiece to the aerosol-generating substrate.

The aerosol-generating substrate may comprise one or more additional components positioned between the aerosol-generating substrate and the mouthpiece, such as a hollow tube, for example a hollow acetate tube, to allow the aerosol generated by the aerosol-generating substrate to cool before reaching the mouthpiece for delivery to the consumer. In those embodiments comprising one or more additional components positioned between the aerosol-generating substrate and the mouthpiece, the paper wrapper preferably circumscribes the one or more additional components.

In any of the embodiments described above, the mouthpiece may comprise a filter. The filter may be formed from one or more suitable filtration materials. Many such filtration materials are known in the art. In one embodiment, the mouthpiece comprises a filter formed from cellulose acetate tow.

The mouthpiece may have a length of between about 5 millimetres and about 14 millimetres. In one embodiment, the mouthpiece may have a length of approximately 7 millimetres.

The aerosol-generating article may be substantially elongate. The aerosol-generating article may be substantially cylindrical in shape.

The aerosol-generating substrate may be substantially elongate. The aerosol-generating substrate may be substantially cylindrical in shape.

The aerosol-generating article may have a total length of between about 30 millimetres and about 100 millimetres. In one embodiment, the aerosol-generating article has a total length of approximately 45 millimetres.

The aerosol-generating article may have an external diameter of between about 5 millimetres and about 12 millimetres. In one embodiment, the aerosol-generating article may have an external diameter of approximately 7.2 millimetres.

The aerosol-generating substrate may have a length of between about 7 millimetres and about 15 mm. In one embodiment, the aerosol-generating substrate may have a length of approximately 10 millimetres. In an alternative embodiment, the aerosol-generating substrate may have a length of approximately 12 millimetres.

The aerosol-generating substrate preferably has an external diameter that is approximately equal to the external diameter of the aerosol-generating article.

The aerosol-generating substrate may have an external diameter of between about 5 millimetres and about 12 millimetres. In one embodiment, the aerosol-generating substrate may have an external diameter of approximately 7.2 millimetres.

The present invention also extends to the use of the paper wrapper in the manufacture of an electrically heated aerosol-generating article, in accordance with any of the embodiments described above. Therefore, according to a third aspect the present invention provides use of a paper wrapper in the manufacture of an electrically heated aerosol-generating article, the paper wrapper having a wet tensile strength of at least about 5 Newtons per 15 millimetres when measured in accordance with the Wet Tensile Strength Test. Preferably, the paper wrapper further comprises a dry tensile strength of at least about 10 Newtons per 15 millimetres when measured in accordance with the Dry Tensile Strength Test.

TEST METHODS

Dry Tensile Strength Test

The Dry Tensile Strength Test (ISO 1924-2) measures the tensile strength of a paper sample conditioned under dry conditions.

Material and equipment:

Universal Tensile/Compression Testing Machine, Instron 5566, or equivalent

Tension load cell of 100 Newtons, Instron, or equivalent

Two pneumatic action grips

A steel gauge block of 180±0.25 millimetres length (width: ~10 millimetres, thickness: ~3 millimetres)

Double-bladed strip cutter, size 15±0.05×~250 millimetres, Adamel Lhomargy, or equivalent Scalpel Computer running acquisition software, Merlin, or equivalent Compressed air Sample preparation:

Condition the paper material for at least 24 hours at 22±2 degrees Celsius and 60±5% relative humidity before testing.

Cut machine direction sample to the following dimensions: ~250×15±0.1 millimetres with the double-bladed strip cutter. The edges of the test pieces must be cut cleanly—do not cut more than three test specimens at the same time Setting up of the instrument:

Install the tension load cell of 100 Newtons

Switch on the Universal Tensile/Compression Testing Machine and the computer

Select the measurement method predefined in the software (test speed set to 8 millimetres per minute)

Calibrate the tension load cell

Install the pneumatic action grips

Adjust the test distance between the pneumatic action grips to 180±0.5 millimetres by means of the steel gauge block Set the distance and the force to zero Testing procedure:

Place the test specimen straight and centrally between the grips, avoid touching the area to be tested with fingers.

Close the upper grip and let the paper strip hang in the opened lower grip.

Set the force to zero.

Pull down lightly on the paper strip, and then close the lower grip by maintaining the force on the test specimen—the starting force must be between 0.05 and 0.20 Newtons.

Start the measurement. While the grip is moving upward, a gradually increasing force is applied until the test specimen breaks.

Repeat the same procedure with the remaining test specimens.

Note: The result is valid when the test specimen breaks at a distance of more than 10 millimetres from the grips. If it is not the case, reject this result and perform an additional measurement.

FIG. 1 illustrates the measuring principle and the relevant dimensions of the test specimen before the test and when stretched during the test.

FIG. 2 illustrates a typical force/elongation curve obtained for a single test specimen and the relevant formulae for calculating the tensile strength and stretch at break.

FIGS. 3A-3B illustrate results of the Dry Tensile Strength Test for standard paper used to construct the reference articles and for RD paper used to construct the test articles, according to an embodiment.

FIGS. 4A-4B illustrate results of the Wet Tensile Strength Test for standard paper and for RD paper, measured for the addition of 2 μL of water, according to an embodiment.

FIGS. 5A-5B illustrate results of the Wet Tensile Strength Test for standard paper and for RD paper, measured for the addition of 2 μL of glycerine, according to an embodiment.

WET TENSILE STRENGTH TEST

Figures 6A, 6B, 7:
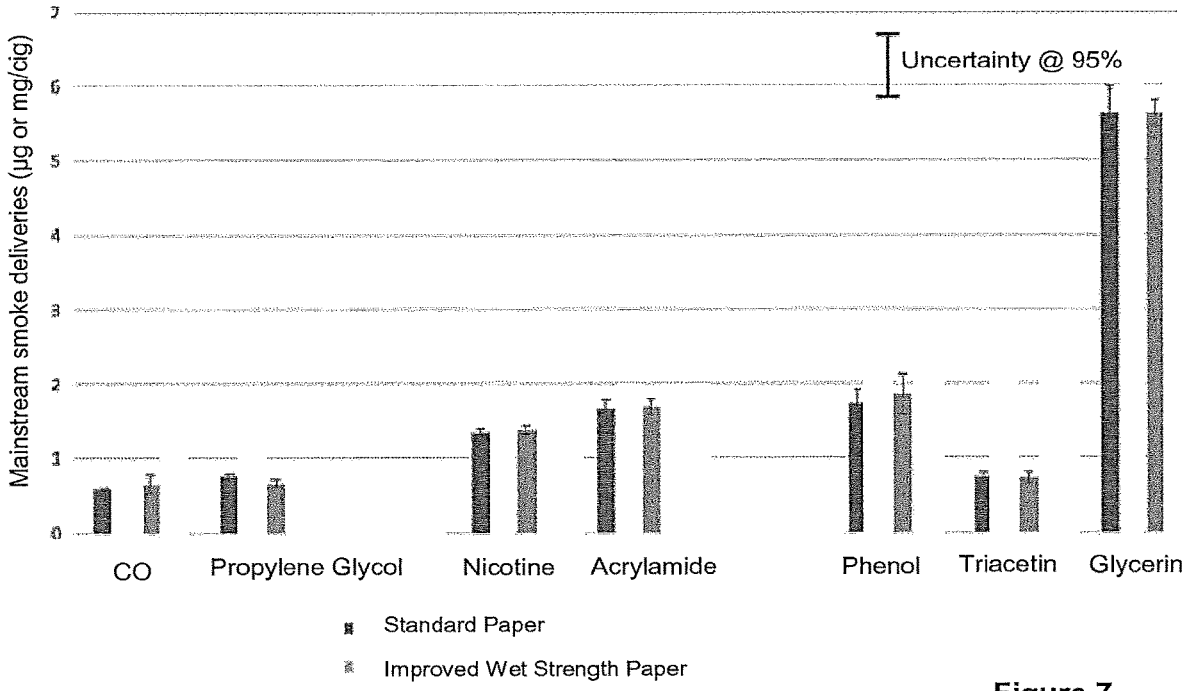
FIGS. 6A-6B illustrate results of the Wet Tensile Strength Test for standard paper and for RD paper, measured for the addition of 2 μL of a 1:1 mixture of water and glycerine, according to an embodiment.
FIG. 7 illustrates results of the smoking test for reference articles constructed with standard paper and for test articles constructed with the RD paper, according to an embodiment.

The Wet Tensile Strength Test measures the tensile strength of a paper sample conditioned under wet conditions. The test is identical to the Dry Tensile Strength Test, except for the addition of 2 micro litres of liquid to the test sample after conditioning for at least 24 hours at 22±2 degrees Celsius and 60±5% relative humidity and after cutting the test sample to size. The 2 micro litres of liquid is applied with a syringe to the centre of the test sample, immediately prior to the pulling step of the test procedure.

Breakage Test

The breakage test subjects an aerosol-generating article comprising a paper outer wrapper to a full heating cycle in the appropriate aerosol-generating device, without puffing, followed by extraction of the aerosol-generating article from the aerosol-generating device. The test is repeated for a number of identical aerosol-generating articles and the percentage of aerosol-generating articles exhibiting a breakage of the paper outer wrapper is determined by a visual inspection.

Smoking Test

To determine the composition of the aerosol generated by an aerosol-generating article the aerosol-generating article is subjected to a heating cycle in the appropriate aerosol-generating device under the Health Canada smoking regime (12 puffs with a puff volume of 55 millilitres, puff duration of 2 seconds and a puff interval of 30 seconds).

EXAMPLE

A number of reference aerosol-generating articles were constructed using an outer wrapper formed from a conventional paper wrapper, and a number of test aerosol-generating articles were constructed. The test aerosol-generating articles were constructed identically to the reference aerosol-generating articles, except the outer wrapper was formed from a paper in accordance with the first aspect of the present invention. The paper used for the test aerosol-generating articles is available from Delfortgroup AG under product code CP.A646.

FIG. 1 illustrates the measuring principle and the relevant dimensions of the test specimen before the test and when stretched during the test. In FIG. 1, w indicates the width of the test specimen in mm; $I_o$ indicates the initial length between grips in mm; I indicates the length between grips during the stretch in mm; $\Delta_I$ indicates the elongation during the stretch (*$I=I-I_o$) in mm; and F indicates the force during the stretch in N.

FIG. 2 illustrates a typical force/elongation curve obtained for a single test specimen and the relevant formulae for calculating the tensile strength and stretch at break. In FIG. 2, the following definitions are for plug wrap paper, cigarette paper, banded cigarette paper, tipping paper, and pre-cut tipping paper: L indicates the load max in N; S indicates the tensile strength in N/mm; "S at break" indicates the tensile breaking strength in N/15 mm; $\varepsilon_b$ indicates the stretch at break in %; $F_{max}$ indicates the maximum force during the stretch in N; w indicates the width of the test specimen in mm; $I_o$ indicates the initial length between grips in mm; $\Delta_{Ib}$ indicates the elongation at break in mm; the tensile breaking strength is given by $$S = \frac{F_{max}}{w} \text{ [N/mm];}$$

the stretch at break is given by $$\varepsilon_b \frac{\Delta l_b}{l_o} \cdot 100[\%];$$

and the force at break of pre-cut tipping paper is given by L=Load Max [N].

The conventional paper (standard paper) used to construct the reference articles and the test paper (RD paper) used to construct the test articles were both subjected to the Dry Tensile Strength Test and the results are recorded in FIGS. 3A-3B. The results show that the conventional paper and the test paper both exhibit substantially the same dry tensile strength, which advantageously permits the use of the test paper in the construction of aerosol-generating article without the need to substantially modify existing manufacturing machines and processes.

The conventional and test papers were also subjected to three separate Wet Tensile Strength Tests: addition of 2 micro litres of water (results recorded in FIGS. 4A-4B); addition of 2 micro litres of glycerine (results recorded in FIGS. 5A-5B); and addition of 2 micro litres of a 1:1 mixture of water and glycerine (results recorded in FIGS. 6A-6B). The Wet Tensile Strength Test results show that the test paper exhibited a significantly larger wet tensile strength when compared to the conventional paper. In the test in which a mixture of water and glycerine was added to the papers, which most closely resembles the moisture content of a typical aerosol-generating substrate in an electrically heated article, the test paper exhibited a wet tensile strength nearly 8 times larger than the wet tensile strength of the conventional paper.

The increased wet tensile strength of the test paper is also evident in the results of the breakage test, in which a number of each of the reference articles and the test articles was subjected to the Breakage Test. Specifically, the reference articles constructed with the conventional paper exhibited breakage in approximately 59 percent of the articles tested, whereas none of the test articles constructed with the test paper exhibited any breakage of the paper wrapper.

Finally, the reference articles constructed with the conventional paper and the test articles constructed with the test paper were both smoked according to the Smoking Test and the results recorded in FIG. 7. The results show that substituting the conventional paper with the test paper did not create any significant change in the composition of the aerosol delivered from the aerosol-generating article.

The invention claimed is:

1. An electrically heated aerosol-generating article comprising:

an aerosol-generating substrate comprising at least one aerosol former in an amount of between 5 percent and 30 percent by weight of the aerosol-generating substrate;

a mouthpiece; and a paper wrapper circumscribing at least a portion of the aerosol-generating substrate, the paper wrapper having a wet tensile strength of at least 5 Newtons per 15 millimetres when measured in accordance with the Wet Tensile Strength Test.

2. The electrically heated aerosol-generating article according to claim 1, wherein the paper wrapper has a dry tensile strength of at least 10 Newtons per 15 millimetres when measured in accordance with the Dry Tensile Strength Test.

3. The electrically heated aerosol-generating article according to claim 1, wherein the at least one aerosol former comprises at least one polyol.

4. The electrically heated aerosol-generating article according to claim 2, wherein the at least one aerosol former comprises at least one polyol.

5. The electrically heated aerosol-generating article according to claim 3, wherein the at least one polyol comprise at least one of sorbitol, glycerol, propylene glycol, and triethylene glycol.

6. The electrically heated aerosol-generating article according to claim 4, wherein the at least one polyol comprise at least one of sorbitol, glycerol, propylene glycol, and triethylene glycol.

7. The electrically heated aerosol-generating article according to claim 1, wherein the aerosol-generating substrate comprises water in an amount of between 10 percent and 20 percent by weight of the aerosol-generating substrate.

8. The electrically heated aerosol-generating article according to claim 2, wherein the aerosol-generating substrate comprises water in an amount of between 10 percent and 20 percent by weight of the aerosol-generating substrate.

9. The electrically heated aerosol-generating article according to claim 3, wherein the aerosol-generating substrate comprises water in an amount of between 10 percent and 20 percent by weight of the aerosol-generating substrate.

10. The electrically heated aerosol-generating article according to claim 4, wherein the aerosol-generating substrate comprises water in an amount of between 10 percent and 20 percent by weight of the aerosol-generating substrate.

11. The electrically heated aerosol-generating article according to claim 5, wherein the aerosol-generating substrate comprises water in an amount of between 10 percent and 20 percent by weight of the aerosol-generating substrate.

12. The electrically heated aerosol-generating article according to claim 6, wherein the aerosol-generating substrate comprises water in an amount of between 10 percent and 20 percent by weight of the aerosol-generating substrate.

13. A method of manufacture of an electrically heated aerosol-generating article, comprising:

circumscribing at least a portion of an aerosol-generating substrate with a paper wrapper having a wet tensile strength of at least 5 Newtons per 15 millimetres when measured in accordance with the Wet Tensile Strength Test.

14. The method according to claim 13, wherein the paper wrapper further comprises a dry tensile strength of at least 10 Newtons per 15 millimetres when measured in accordance with the Dry Tensile Strength Test.

* * * * *